US011432633B2

(12) United States Patent
Strickland

(10) Patent No.: US 11,432,633 B2
(45) Date of Patent: Sep. 6, 2022

(54) NAIL CLEANING PEN TOOL AND METHOD

(71) Applicant: Angela Strickland, Bradenton, FL (US)

(72) Inventor: Angela Strickland, Bradenton, FL (US)

( * ) Notice: Subject to any disclaimer, the term of this patent is extended or adjusted under 35 U.S.C. 154(b) by 215 days.

(21) Appl. No.: 15/846,123

(22) Filed: Dec. 18, 2017

(65) Prior Publication Data

US 2018/0168315 A1 Jun. 21, 2018

Related U.S. Application Data

(60) Provisional application No. 62/435,498, filed on Dec. 16, 2016.

(51) Int. Cl.

| | |
|---|---|
| ***A45D 29/18*** | (2006.01) |
| ***A45D 29/17*** | (2006.01) |
| ***A45D 29/16*** | (2006.01) |
| ***A46B 11/00*** | (2006.01) |
| ***A45D 34/04*** | (2006.01) |
| ***A45D 29/11*** | (2006.01) |
| ***A45D 40/20*** | (2006.01) |
| ***A45D 29/00*** | (2006.01) |

(52) U.S. Cl.

CPC ..... *A45D 29/17* (2013.01); *A45D 29/00* (2013.01); *A45D 29/11* (2013.01); *A45D 29/16* (2013.01); *A45D 34/042* (2013.01); *A45D 40/20* (2013.01); *A46B 11/001* (2013.01); *A46B 2200/205* (2013.01)

(58) Field of Classification Search

CPC ..... A45D 29/00; A45D 29/007; A45D 29/06; A45D 29/16; A45D 29/17; A45D 29/18; A45D 29/11; A45D 34/042; A45D 40/20; A45D 2200/10; A45D 2200/1009

USPC ..... 401/37–39

See application file for complete search history.

(56) References Cited

U.S. PATENT DOCUMENTS

| | | | | |
|---|---|---|---|---|
| 1,856,854 | A * | 5/1932 | Schwanhausser | A45D 29/18 132/75.3 |
| 2,035,323 | A * | 3/1936 | Langdon | A45D 29/16 132/75.3 |
| 2,876,782 | A * | 3/1959 | Hudgens | A45D 29/16 132/74.5 |
| 4,966,483 | A * | 10/1990 | Hashimoto | A45D 34/042 222/213 |
| 5,762,077 | A * | 6/1998 | Griffiths, Jr. | A45D 29/007 132/318 |
| 8,534,945 | B2 * | 9/2013 | Muhr-Sweeney | B08B 3/04 401/34 |
| 8,662,089 | B2 | 3/2014 | Hwang | |
| 2008/0120798 | A1 * | 5/2008 | Sorrentino | A46B 15/0069 401/132 |
| 2016/0143415 | A1 * | 5/2016 | Laaly | A45D 34/042 401/193 |

* cited by examiner

*Primary Examiner* — Rachel R Steitz

(74) *Attorney, Agent, or Firm* — Invention To Patent Services; Alex Hobson

(57) ABSTRACT

A tool for cleaning and disinfecting is disclosed herein. The tool for cleaning and disinfecting includes an elongated body, a brush portion, and a hook portion. The elongated body may be configured to house a fluid therein. The fluid may be a sanitizing agent or a cuticle oil. The tool for cleaning and disinfecting is useful for cleaning and disinfecting a surface.

12 Claims, 5 Drawing Sheets

NAIL CLEANING PEN TOOL AND METHOD

CROSS REFERENCE TO RELATED APPLICATION

The present application is related to and claims priority to U.S. Provisional Patent Application No. 62/435,498 filed Dec. 16, 2016, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of nail accessories and more specifically relates to a nail cleaning and disinfecting pen tool.

2. Description of Related Art

The most common method used to eradicate potential germs, bacteria, viruses and other biological agents, so far, is hand washing. Sanitizers, and hand sanitizers in particular, have become increasingly popular in the last decade. Hand sanitizers are present in hospitals around the world, carried in people's bags, used before meals, etc. The issue, however, is that these hand sanitizing fluids do little to thoroughly clean and disinfect the fingernail, particularly underneath the fingernail. Such areas maintain high germ, bacteria, virus, and biological agent cultures after application of today's products. If an individual chooses not to wash their hands and fingernails after contracting visible dirt and debris, contamination of food and other products could occur. Thus, a suitable solution is desired.

U.S. Pat. No. 8,662,089 to Yong Bum Hwang relates to a nail-cleaning tool. The described nail-cleaning tool includes a body part and the body part has an oil reservoir therein. An abrasive member and a nib are protruded from the body part. The nib is connected to the oil reservoir so that oil is supplied to the nib from the oil reservoir, and the nib and the abrasive member are aligned to be in contact with each other by their faces along the longitudinal direction of the body part.

BRIEF SUMMARY OF THE INVENTION

In view of the foregoing disadvantages inherent in the known nail accessories art, the present disclosure provides a novel nail cleaning pen tool and method. The general purpose of the present disclosure, which will be described subsequently in greater detail, is to provide a means of effective sanitization for fingernails.

A tool for cleaning and disinfecting is disclosed herein. The tool for cleaning and disinfecting may include an elongated body having a first end, a second end, and a hollow interior, and the hollow interior may be configured to house a fluid. Further, the tool may include a brush portion removably attached to the first end of the elongated body, and a hook portion removably attached to the second end of the elongated body. The tool may be configured to clean and disinfect a surface.

A method of using a nail cleaning pen tool for cleaning and disinfecting is also disclosed herein. The method of using a nail cleaning pen tool for cleaning and disinfecting may comprise the steps of: providing the tool as above, applying the soft hook of the hook portion to an underside of the fingernail to remove dirt, debris and bacteria; applying pressure to the rubber grip of the brush portion to release the fluid onto the plurality of bristles; and applying the plurality of bristles of the brush portion to a top surface of the fingernail.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a nail cleaning pen tool and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to nail accessories and more particularly to a nail cleaning pen tool and method as used to improve the nail cleaning and disinfecting pen tool.

Generally, the present disclosure may provide users with a fingernail cleaner designed to clear all fingernails of dirt, debris, bacteria, and the like. The tool may feature a soft bristle-type brush which, with a gentle squeeze of a rubber gripper may dispense antibacterial hand sanitizing gel for additional fingernail cleaning. Further, the tool may include a pointed tip on the bottom end, allowing users to clean underneath the fingernails with ease. This may eliminate the worry of germs and bacteria lingering on the fingers and hands which ensures all items touched by an individual are never contaminated. The tool may offer a simple, highly-portable method for cleaning fingernails at any time.

The tool may be a uniquely-designed personal grooming tool capable of efficiently cleaning on top and underneath fingernails. The tool may be comprised of a pen-like structure with a hollow interior, a bristle end, and a soft hook-like end. The device may be filled with gel hand sanitizer which is dispensed through an opening on the bristle end. It should be appreciated that gel hand sanitizers may not be the only fluid that can be inserted into the follow interior of the tool. For example, cuticle oil may be used.

The bristle end may be intended to clean the top portion of fingernails while the hook-like end may easily clean underneath the nail. Further, the bristle end may be designed to reach up underneath the nail so the dispensed sanitizer can kill germs and bacteria—the bristles may scrub and loosen dirt so the hook end can easily remove trapped debris.

A user may fill the device with hand sanitizer and then squeeze a rubber grip located slightly above the hook end. The rubber grip may be intended to apply pressure to the hand sanitizer and allow it to exit the bristle end. The bristles may utilize the sanitizer in order to clean the fingernail on top and underneath. If there is debris underneath the nail, the hook-like end can be used to clear the dirt/debris. Both ends work together to ensure a user's hands and fingers are consistently clean.

Further, the device may be constructed using plastic, rubber, and other suitable materials. The device may be available in a universal size and numerous colors, all suited to accommodate user needs and preferences. Exact size, measurement, construction, and design specifications may vary upon manufacturing.

Referring now more specifically to the drawings by numerals of reference, there is shown in FIGS. 1-5, various views of a tool for cleaning and disinfecting 100.

Figure 1:
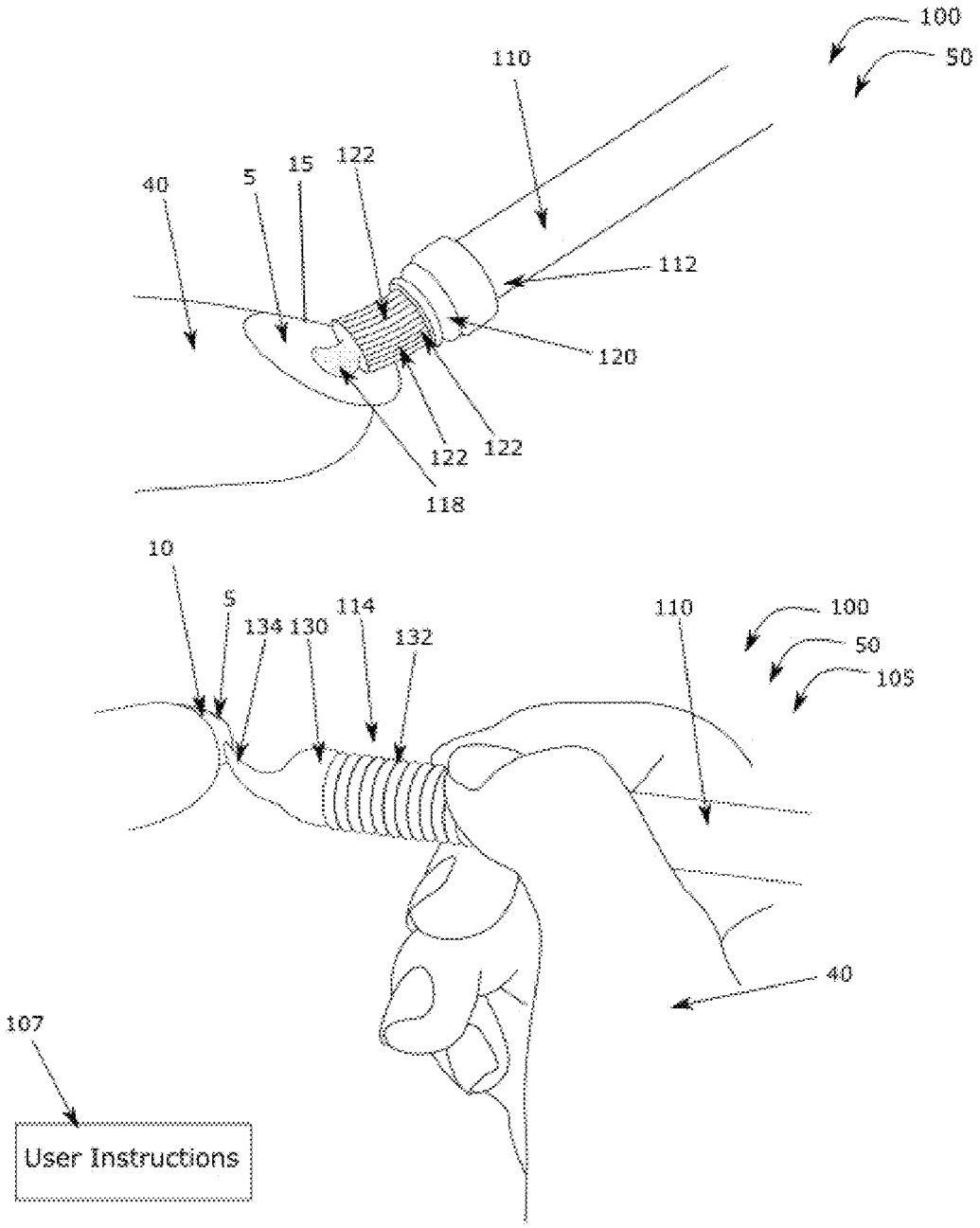
FIG. 1 is a side perspective view of the tool for cleaning and disinfecting during an 'in-use' condition, according to an embodiment of the disclosure.

FIG. 1 shows a tool for cleaning and disinfecting 100, according to an embodiment of the present disclosure. As Illustrated, the tool for cleaning and disinfecting 100 may include an elongated body 110, a brush portion 120, and a hook portion 130. As shown, the elongated body 110 may house a fluid 118. Further illustrated in a preferred embodiment, the tool 100 may be configured to clean and disinfect a surface (here, the surface is shown as a top surface 15 of a fingernail 5 and an underside 10 of the fingernail 5.

Figure 2:
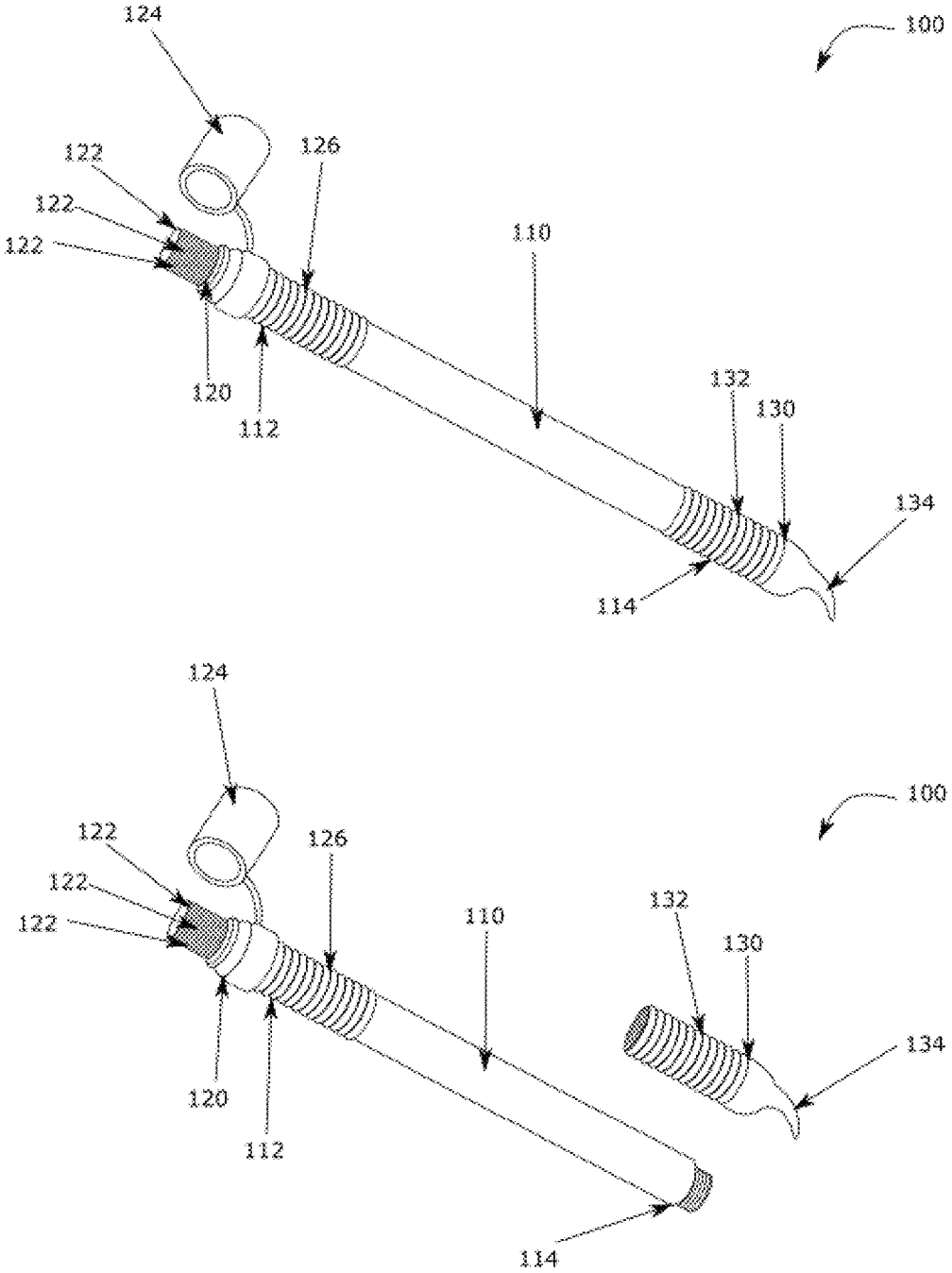
FIG. 2 is a side perspective view of the tool for cleaning and disinfecting of FIG. 1, according to an embodiment of the present disclosure.

FIG. 2 shows a front perspective view of the tool for cleaning and disinfecting 100 of FIG. 1, according to an embodiment of the present disclosure. As illustrated in this figure, the elongated body 110 may include a first end 112, a second end 114, and a hollow interior 116. The hollow interior 116 may be configured to house the fluid 118. In the preferred embodiment, the elongated body 110 may include a cylindrical shape. In this embodiment, the elongated body 110 may include a conventional pen-shape. The hollow interior 116 may be configured to house at least 1 oz of fluid 118. However, it should be appreciated that the hollow interior 116 may be manufactured in a variety of sizes to house a variety of fluid 118 amounts.

The brush portion 120 may be removably attached to the first end 112 of the elongated body 110, and, similarly, the hook portion 130 may be removably attached to the second end 114 of the elongated body 110. The brush portion 120 may include a plurality of bristles 122 sized to contact the top surface 15 of the fingernail 5 and the underside 10 of the fingernail 5. In the preferred embodiment, the plurality of bristles 122 may be made of synthetic fibers. In further examples, the plurality of bristles 122 may be made from a natural hair. Each of the plurality of bristles 122 may be at least 0.25 inches in length, and similarly, the hook portion 130 is at least 0.25 inches in length.

As demonstrated, the hook portion 130 may include a rubber grip 132 which may be in fluid 118 communication with the hollow interior 116 of the elongated body 110. Further, the rubber grip 132 may be configured to release the fluid 118 upon application of pressure on the rubber grip 132. In addition, the hook portion 130 may further include a soft hook 134 sized to contact an underside 10 of a fingernail 5 to remove dirt, debris and bacteria (FIG. 1). In the preferred embodiment, the hook portion 130 may be made from a plastic. In one example, the plastic may be a soft plastic such as polyethylene. In further embodiments, the hook portion 130 may be made from a rubber, a silicone, or the like.

As illustrated, the tool 100 may further include a protective cap 124 removably attached to the brush portion 120. In the preferred embodiment, the protective cap 124 may be made from a plastic. In one example, the plastic may be polypropylene. In other embodiments, the protective cap 124 may be made from a rubber, a metal, or the like. Further, as shown, the brush portion 120 may include a second rubber grip 126 which may aid the user 40 in gripping the tool 100.

Figure 3:
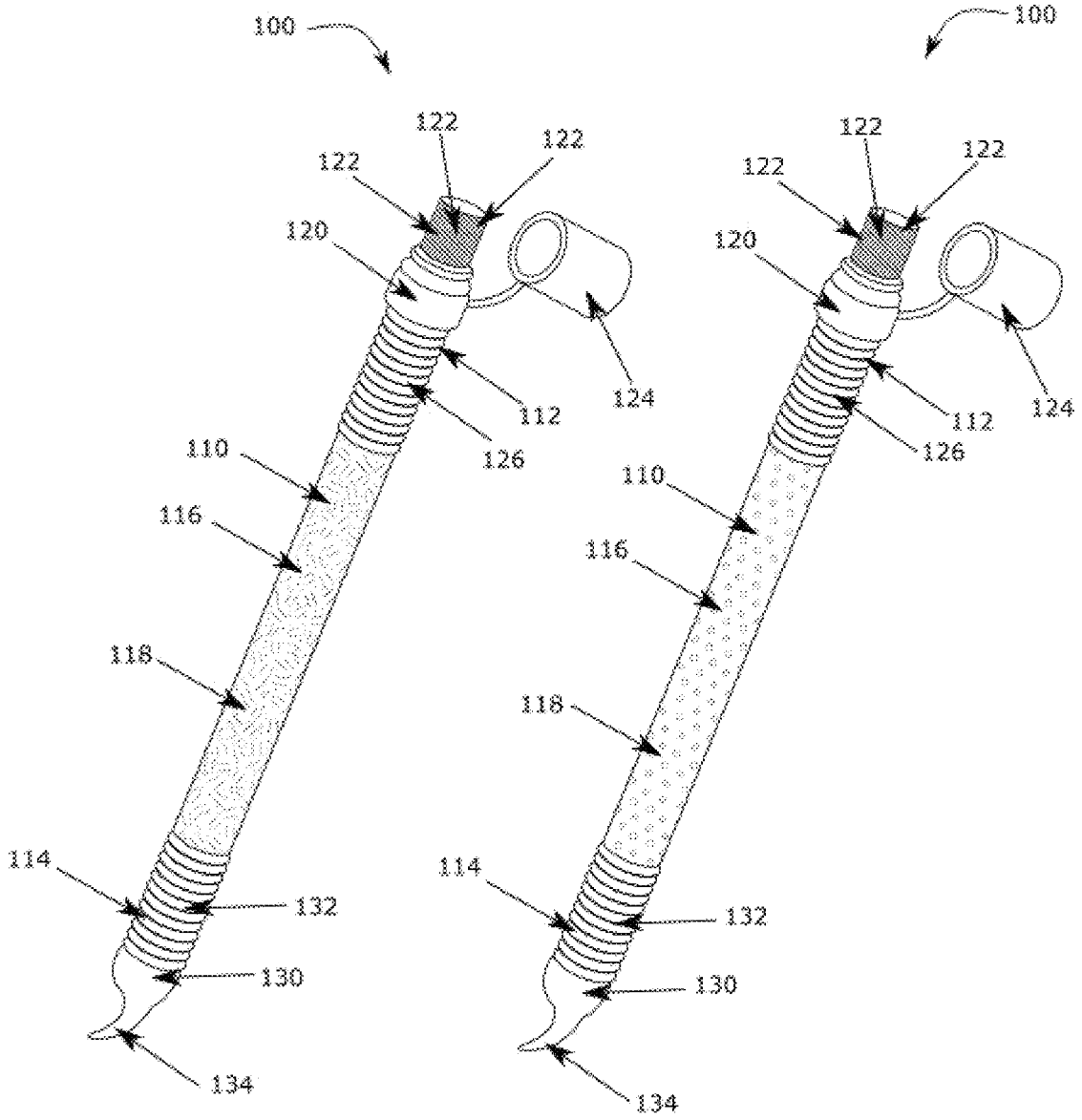
FIG. 3 is a side perspective view of the tool for cleaning and disinfecting of FIG. 1, illustrating a fluid inside the tool, according to an embodiment of the present disclosure.

FIG. 3 shows a front perspective view of the tool for cleaning and disinfecting 100 of FIG. 1, according to an embodiment of the present disclosure. As shown, the hollow interior 116 may be configured to house the fluid 118. In the preferred embodiment, the fluid 118 may be a sanitizing agent. The sanitizing agent may be an alcohol-based liquid/gel composition. The alcohol-based composition may contain isopropyl alcohol, ethanol or the like, in a quantity of between 60%-95%. The composition may include a moisturizing agent such as glycerol to prevent drying of cuticles, the fingernail, and skin around the fingernail. In a further embodiment, the sanitizing agent may be a non-alcohol based composition. In this embodiment, the composition may contain bezalkonium, chloride or triclosan to provide effective sanitation. The hollow interior 116 may be configured to house at least 1 oz of fluid 118. However, it should be appreciated that the hollow interior 116 may be manufactured in a variety of sizes to house a variety of fluid 118 amounts.

In another embodiment, the fluid 118 may be cuticle oil. The cuticle oil may contain moisturizing properties to soften the cuticle. As an example, the moisturizing properties may include oils such as sunflower oil, jojoba oil, vitamin E oil, olive oil, sweet almond oil, and the like.

Figure 4:
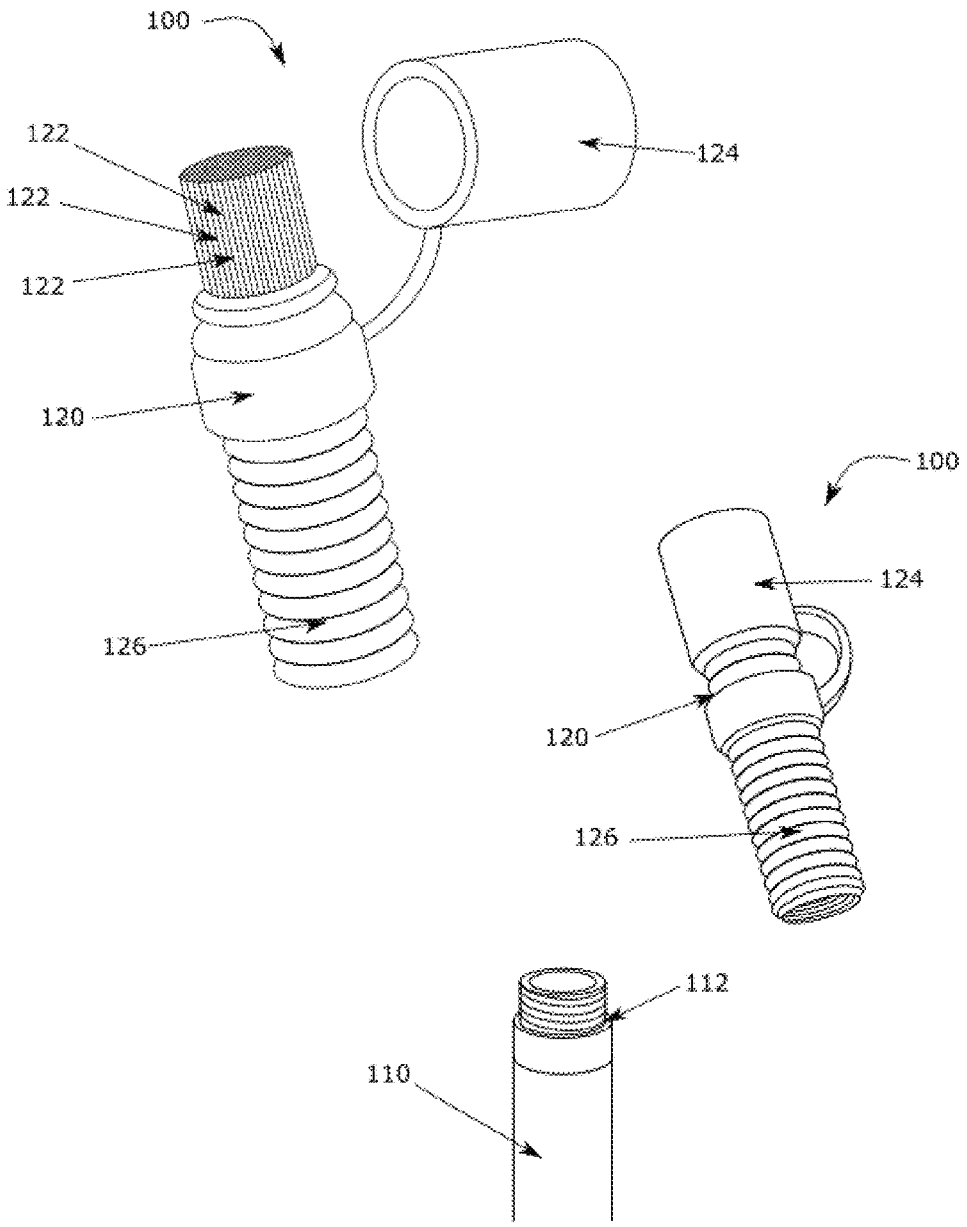
FIG. 4 is a side perspective view of the tool for cleaning and disinfecting of FIG. 1, according to an embodiment of the present disclosure.

FIG. 4 shows a front perspective view of the tool for cleaning and disinfecting 100 of FIG. 1, according to an embodiment of the present disclosure. As above, the tool for cleaning and disinfecting 100 may include the elongated body 110, the brush portion 120, and the hook portion 130. As shown, brush portion 120 may include the protective cap 124 which may be removably attached to the brush portion 120. Further, the brush portion 120 may be removably attached to the first end 112 of the elongated body 110. In one embodiment, the brush-portion 120 may be removed from the first end 112 of the elongated body 110 to allow for re-fill of the fluid 118 into the hollow interior 116. Further, as above, the brush portion 120 may include the second rubber grip 126.

Figure 5:
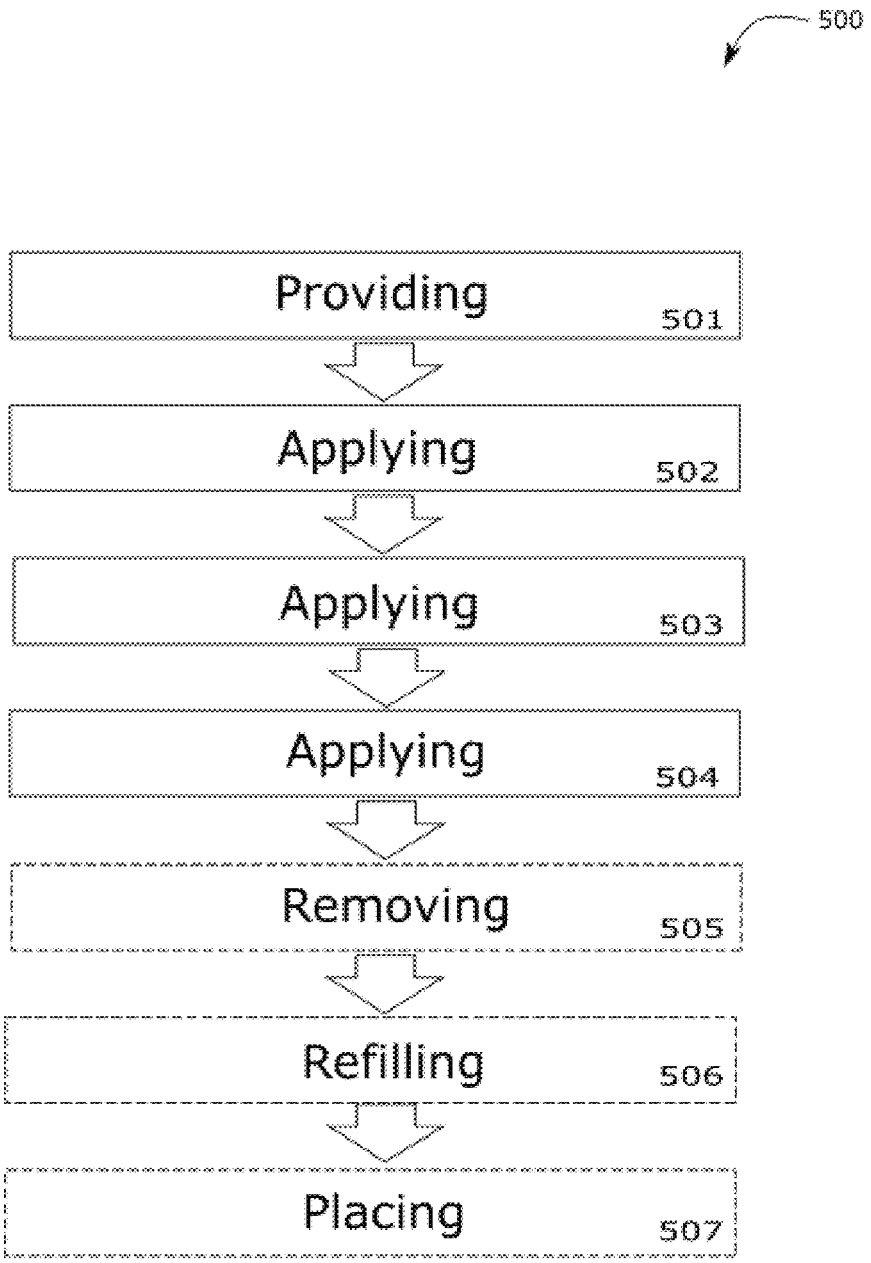
FIG. 5 is a flow diagram illustrating a method of use for tool for cleaning and disinfecting, according to an embodiment of the present disclosure.

FIG. 5 is a flow diagram 550 illustrating a method of using a tool for cleaning and disinfecting a fingernail, the method comprising the steps of: 500, according to an embodiment of the present disclosure. As illustrated, the method of using a tool for cleaning and disinfecting a fingernail, the method comprising the steps of: step one 501, providing the tool 100 as above; step two 502, applying the soft hook 134 of the hook portion 130 to an underside 10 of the fingernail 5 to remove dirt, debris and bacteria; step three 503, applying pressure to the rubber grip 132 of the hook portion 130 to release the fluid 118 onto the plurality of bristles 122; step four 504, applying the plurality of bristles 122 of the brush portion 120 to a top surface of the fingernail 5. Further steps may include: step five 505, removing the hook portion 130 from the elongated body 110 to reveal the hollow interior 116; step six 506, refilling the hollow interior 116 with the fluid 118; and step seven 507, placing the hook portion 130 back onto the elongated body 110.

It should be noted that step five 505, step six 506 and step seven 507 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for tool for cleaning and disinfecting 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

The invention claimed is:

1. A tool for cleaning and disinfecting a fingernail, the tool comprising, a sanitizing fluid;

an elongated body, the elongated body having a first end, a second end, and a hollow interior, wherein the hollow interior is configured to house said sanitizing fluid;

a brush portion, the brush portion removably attached to the first end of the elongated body and comprising:

a plurality of bristles being sized to contact a top surface of said fingernail and an underside of said fingernail;

a first rubber grip coupled to the first end of the elongated body and configured to aid a user in gripping the tool;

a hook portion configured on the second end of the elongated body and comprising:

a hook that is curved to a point on an extended end and sized to contact an underside of said fingernail to remove dirt, debris and bacteria;

a second rubber grip configured between the hook and the second end of the elongated body and in fluid communication with the hollow interior of the elongated body;

wherein the hook portion is a monolithic component including the hook and the second rubber grip;

wherein the hook portion is removably attached to the second end of the elongated body;

wherein the second rubber grip is configured to release the sanitizing fluid from the elongated body through the brush portion on the first end upon application of pressure on said second rubber grip; and wherein the tool is configured to clean and disinfect a surface.

2. The tool of claim 1, further comprising a protective cap, and wherein the protective cap is plastic.

3. The tool of claim 1, wherein the hook portion is plastic.

4. The tool of claim 1, wherein the hook portion is made of silicone.

5. The tool of claim 1, wherein the bristles are made of synthetic fibers.

6. The tool of claim 1, wherein the sanitizing fluid comprises an alcohol.

7. The tool of claim 1, wherein the elongated body has a cylindrical shape.

8. The tool of claim 1, wherein each of the plurality of bristles is at least 0.25 inches in length.

9. The tool of claim 1, wherein the hook portion is at least 0.25 inches in length.

10. The tool of claim 1, wherein the hollow interior is configured to house at least 1 oz of fluid.

11. A method of cleaning and disinfecting a fingernail comprising:

providing the tool for cleaning and disinfecting of claim 1;

applying the hook of the hook portion to an underside of the fingernail to remove dirt, debris and bacteria;

applying pressure to the second rubber grip of the hook portion to release the fluid onto the plurality of bristles; and applying the plurality of bristles of the brush portion to a top surface of the fingernail.

12. The method of claim 11, further comprising the steps of:

removing the hook portion from the elongated body to reveal the hollow interior;

refilling the hollow interior with the fluid; and placing the hook portion back onto the elongated body.

* * * * *